United States Patent [19]

Gartner

[11] Patent Number: 4,574,546

[45] Date of Patent: Mar. 11, 1986

[54] APPARATUS FOR CONNECTING UPPER AND LOWER UNITS IN A UNIT TYPE CURTAIN WALL

[75] Inventor: Karl Gartner, Gundelfingen, Fed. Rep. of Germany

[73] Assignee: Yoshida Kogyo K. K., Tokyo, Japan

[21] Appl. No.: 519,206

[22] Filed: Aug. 1, 1983

[51] Int. Cl.[4] ..... E04H 1/00

[52] U.S. Cl. ..... 52/235; 52/474

[58] Field of Search ..... 52/726, 475–477, 52/220, 656, 234, 235, 474; 165/53, 56; 285/266

[56] References Cited

U.S. PATENT DOCUMENTS

| | | | |
|---|---|---|---|
| 1,236,142 | 8/1917 | Brogden | 52/474 |
| 1,345,971 | 7/1920 | Star | 285/226 |
| 2,996,845 | 8/1961 | Cipriani et al. | 52/477 |
| 3,053,353 | 11/1961 | Miller | 52/220 |
| 3,522,684 | 8/1970 | Grossman | 52/726 |
| 4,458,745 | 7/1984 | Gartner | 165/56 |

*Primary Examiner*—James L. Ridgill, Jr.

*Attorney, Agent, or Firm*—Hill, Van Santen, Steadman & Simpson

[57] ABSTRACT

A plurality of multiplicity of standardized curtain wall units are arranged in rows and columns to provide a unit type curtain wall assembly. For interconnecting each column of curtain wall units so as to allow relative displacement thereof in their own vertical plane while holding them against relative displacement out of the vertical plane, a pair of horizontally spaced couplings are provided between any two vertically adjoining curtain wall units. Each coupling comprises a male member attached to either of the upper and lower curtain wall units and having a tongue projecting vertically therefrom, and a female member mounted to the other curtain wall unit and defining a groove for slidably receiving the tongue of the male member. Also included is a stringcourse extending along the seam between every two vertically adjoining curtain wall units and disposed exteriorly of the couplings for rain-proofing the seam. The unit type curtain wall assembly may be equipped with a room temperature control system.

8 Claims, 8 Drawing Figures

APPARATUS FOR CONNECTING UPPER AND LOWER UNITS IN A UNIT TYPE CURTAIN WALL

BACKGROUND OF THE INVENTION

This invention relates to a unit type curtain wall assembly having an array of curtain wall units connected to one another at top and bottom and to left and right, with and without facilities for the temperature control of the rooms enclosed thereby, and more particularly to improved means for interconnecting every two vertically adjoining curtain wall units in such a unit type curtain wall assembly.

In constructing curtain wall assemblies of the unit type under consideration, the usual practice has been to couple together the curtain wall units at every point where the corners of four neighboring units meet, for attachment to a floor system of a building. The joints or seams of the curtain wall units have simply been filled with a backup material and caulked. These conventional connections between curtain wall units provide only air- and water-tight joints therebetween; they are not intended to bear the curtain wall units against relative displacement out of the vertical plane in which they normally lie. In case of the conventional unit type curtain wall, respective curtain wall units positioned at top and bottom and to left and right in a crossed portion of the unit type curtain wall assembly are borne by a fastener portion, one side of which is formed in a fixed type and the other side of which is allowed to oscillate. Accordingly, it is another drawback of the conventional unit type curtain wall assembly to make the construction and the connection of the fastener portion unavoidably complex. Further, by reason of the complex construction of the fastener portion, it becomes difficult to assemble and mount the curtain wall units in the site of building construction.

A recent breakthrough in the art of unit type curtain wall is those with a temperature control system for the room enclosed thereby. Japanese Patent Application No. 57-133764, filed by the same applicant as in the present application, discloses an example of unit type curtain wall assembly capable of room temperature control. According to this assembly disclosed in the separate application, conditioned air is supplied through passageways in the vertical and horizontal frame members of the curtain wall units, for delivery into the rooms through vents in one of the horizontal frame members of each unit.

This unit type curtain wall assembly also has a problem with regard to the vertical connection between the curtain wall units. The air passageways in the vertical frame members of vertically adjoining curtain wall units must intercommunicate for uninterrupted flow of the conditioned air therethrough. Thus, unless the vertical frame members of the adjacent curtain wall units are positively held against relative displacement out of alignment, their joints are susceptible to rupture, with consequent leakage of air, when the unit type curtain wall assembly is loaded in directions at angles to its plane. A rigid interconnection of the aligned vertical frame members is objectionable, however, because then the individual curtain wall units would not be relatively displaceable in their own plane, inviting ready destruction of the unit type curtain wall assembly as in the event of an earthquake.

SUMMARY OF THE INVENTION

This invention makes it possible, in a unit type curtain wall assembly, to interconnect vertically adjoining curtain wall units by such simpler means than heretofore, so as to allow the relative displacement of the curtain wall units in their own plane while positively locking them against relative displacement out of that plane. The inventive concepts are applicable equally well to unit type curtain wall assemblies having a built-in room temperature control system and to those having no such system.

Stated broadly, the invention provides, in a unit type curtain wall assembly composed of a plurality of standardized curtain wall units arrayed in rows and columns, the improvement comprising two or more horizontally spaced apart couplings between any two vertically adjoining curtain wall units. Each coupling comprises a female member attached to either of the two vertically adjoining curtain wall units, and a male member attached to the other. The female member defines a groove extending in the vertical plane of the unit type curtain wall assembly, whereas the male member has a tongue slidably engaged in the groove in the female member. The joint or seam between every two vertically adjoining curtain wall units is closed by a stringcourse sealingly mounted therebetween and disposed exteriorly of the couplings to make the joint impervious to water.

Despite their simplicity in construction, the couplings are well calculated to permit relative displacement of the vertically adjoining curtain wall units in their own vertical plane but nevertheless to firmly restrain them from relative displacement out of the vertical plane. Consequently the couplings can bear the curtain wall units against a load applied in a direction at an angle to their plane, as by the wind. In the event of an earthquake, moreover, the couplings can efficiently take up the relative displacement of the curtain wall units in their own plane, rather than transmitting such displacements to the other units or to the other parts of the building.

Vertically interconnected as above, the curtain wall units can be mounted to the floor systems of a building by means on the pair of side frame members of each unit. The mounting means are also much simplified in comparison with the prior art. The simplicity of the mounting means, and of the couplings with their interfitting male and female members, makes it materially easier to assemble the curtain wall units side by side and one on top of another into a complete unit type curtain wall assembly.

As an additional advantage the horizontal seams between the curtain wall units are made rainproof by the stringcourses mounted in position on the outside of the couplings. The stringcourses are well designed to keep the seams rainproof despite the possible relative displacement of the individual curtain wall units explained above.

In one preferred embodiment disclosed herein, the invention is applied to a unit type curtain wall assembly with a built-in room temperature control system. In this application the side frame members of the vertically adjoining curtain wall units are joined end to end via bellows or like hollow flexible members so as to intercommunicate the passageways extending therethrough for the flow of conditioned air. The curtain wall units are of course vertically interconnected by the noted couplings with their interfitting male and female members. No air leakage is therefore to occur through rupture of the bellows or the like when the curtain wall assembly is loaded at an angle to its plane, since the individual curtain wall units are firmly held by the couplings against relative displacement in the direction perpendicular to the face of such loading. Further the bellows or the like do not interfere with the desired relative displacement of the curtain wall units in their own plane which is permitted by the couplings.

According to a further feature of the invention a mass of thermal insulating material is filled in the gap between every two vertically adjoining curtain wall units. Disposed interiorly of the stringcourse, the thermal insulating material serves to enhance the room temperature control capability of the unit type curtain wall assembly in spite of its prefabricated unit construction.

The above and other features and advantages of this invention and the manner of attaining them will become more apparent, and the invention itself will best be understood, from a study of the following description and appended claims taken together with the attached drawings showing some preferred embodiments of the invention.

DESCRIPTION OF THE PREFERRED EMBODIMENTS

Figure 1:
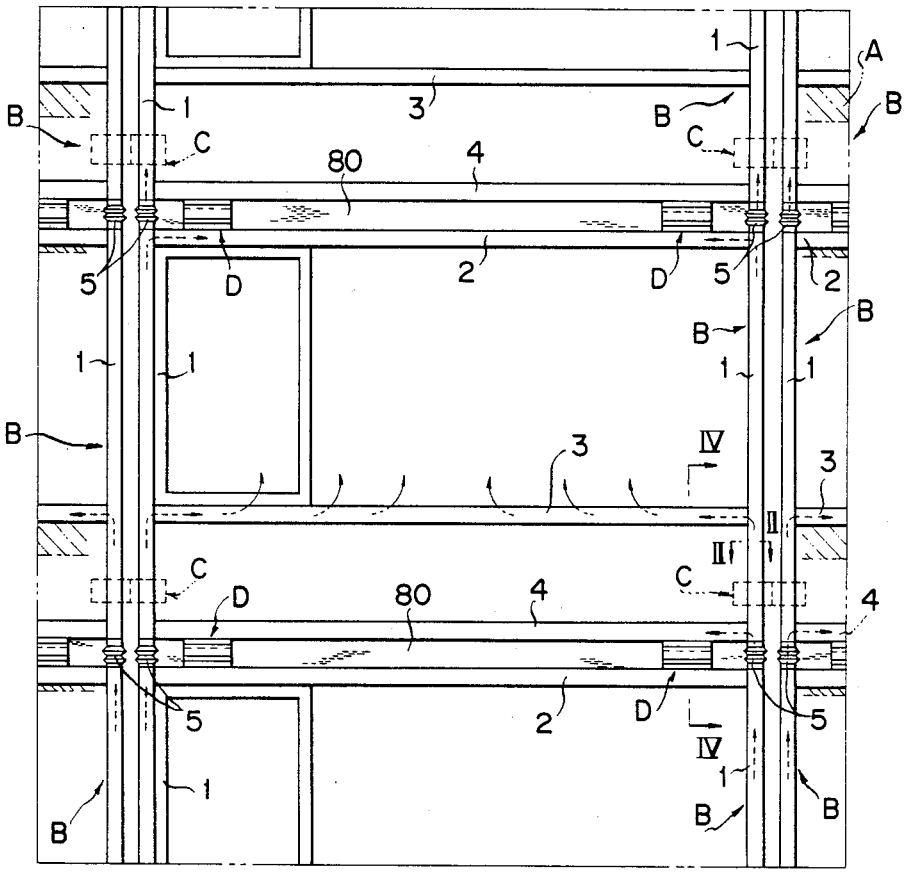
FIG. 1 is a partial elevation of a preferred form of the unit type curtain wall assembly, with provisions for room temperature control, incorporating the novel concepts of the present invention.

The exemplified unit type curtain wall assembly of FIG. 1 comprises a plurality or multiplicity of standardized curtain wall units B arrayed in rows and columns in a vertical plane. Each curtain wall unit B has a pair of vertical side frame members 1, a horizontal top frame member 2, a plinth 3, and a horizontal bottom frame member 4. The side, top and bottom frame members 1, 2 and 4 are combined into a rectangular shape. The plinth 3 extends horizontally between the pair of side frame members 1 and lies intermediate the top and bottom frame members 2 and 4, closer to the bottom frame member than to the top frame member.

Each curtain wall unit B of the above general organization is mounted to a floor system A by a pair of mounting means C adjacent the lower ends of the respective side frame members 1. Every two vertically adjoining ones of the curtain wall units B are interconnected by a plurality of, two in the illustrated embodiment, couplings D constituting a feature of this invention. Each illustrated pair of couplings D interconnect the bottom frame member 4 of an upper curtain wall unit and the top frame member 2 of a lower curtain wall unit in the vicinities of their opposite ends.

The unit type curtain wall assembly of FIG. 1 is equipped for room temperature control. To this end of the frame members 1, 2 and 4 and plinth 3 of each curtain wall unit have each formed longitudinally therethrough a first passageway for conditioned air and a second passageway for a heat transfer medium such as cooling or heating water, both passageways being not seen in FIG. 1. The conditioned air flowing through the first passageways is delivered into the rooms through vents in the plinth 3 of each curtain wall unit, as indicated by the arrows in FIG. 1. The heat transfer medium circulating through the second passageways, on the other hand, radiates heat into the room through the exposed surfaces in the inside of the room of the frame members and plinths of the curtain wall units.

At 5 in FIG. 1 are shown hollow flexible members, typically in the form of bellows, joining the side frame members 1 of the vertically adjoining curtain wall units B end to end so as to intercommunicate the first passageways therein. Thus the first passageways 6 in each vertical series of side frame members 1 intercommunicate into a continuous airflow path. The first passageways 6 in the lowermost side frame members 1 lead to a source of conditioned air (not shown).

The second passageways 7 in the frame members 1, 2 and 4 and plinth 3 of each curtain wall unit B intercommunicate in proper portions to provide an independent circuit for the circulation of the heat transfer medium. This circuit communicates with a source of the heat transfer medium and with a drain (both not shown).

Figure 2:
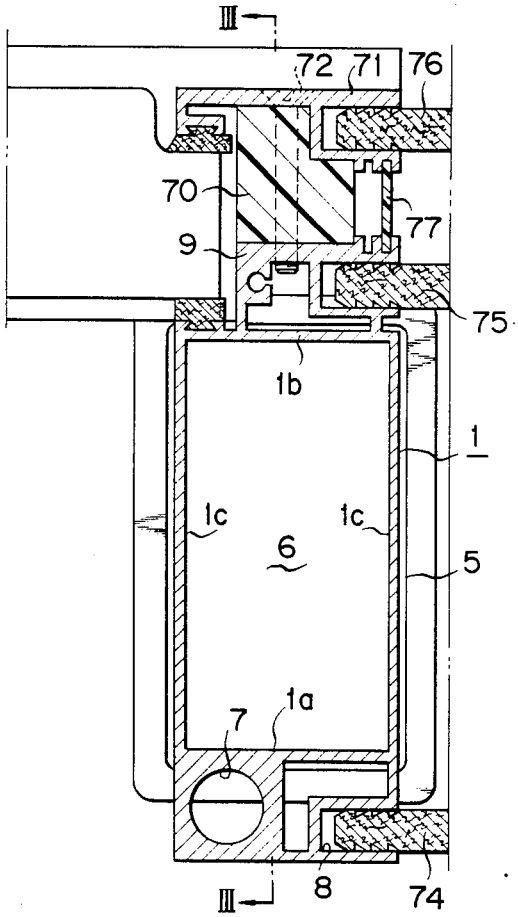
FIG. 2 is an enlarged, fragmentary horizontal section through the unit type curtain wall assembly, taken along the line II—II of FIG. 1, the view showing in particular one of the side frame members of one of the curtain wall units.

FIG. 2 is an enlarged cross section through one of the side frame members 1 of each curtain wall unit. The representative side frame member 1 has an interior wall 1*a*, an exterior wall 1*b*, and a pair of side walls 1*c*, which are combined into a generally rectangular shape to bound the noted first passageway 6 for conditioned air. The interior wall 1*a* and exterior wall 1*b* are directed toward the inside and toward the outside, respectively, of in the members disposed in the room of the unit type curtain wall assembly. Thicker than the other walls 1*b* and 1*c*, the interior wall 1*a* has the aforesaid second passageway 7 for the heat transfer medium and a recess 8 formed therein in transversely spaced apart relation to each other. The recess 8 engages one edge of a sealing band 74 closing the seam between the side frame members of the neighboring curtain wall units. The sealing band 74 has a heat insulating function as well.

Formed exteriorly of and integral with the exterior wall 1*b* of each side frame member 1 is a connector 9 to which a retainer strip 71 is fastened by countersunk screws 72 via a heat insulator 70 and a coupling plate 77 of thermal insulating material. Two additional sealing bands, similar to the one at 74, are provided at 75 and 76.

Figure 3:
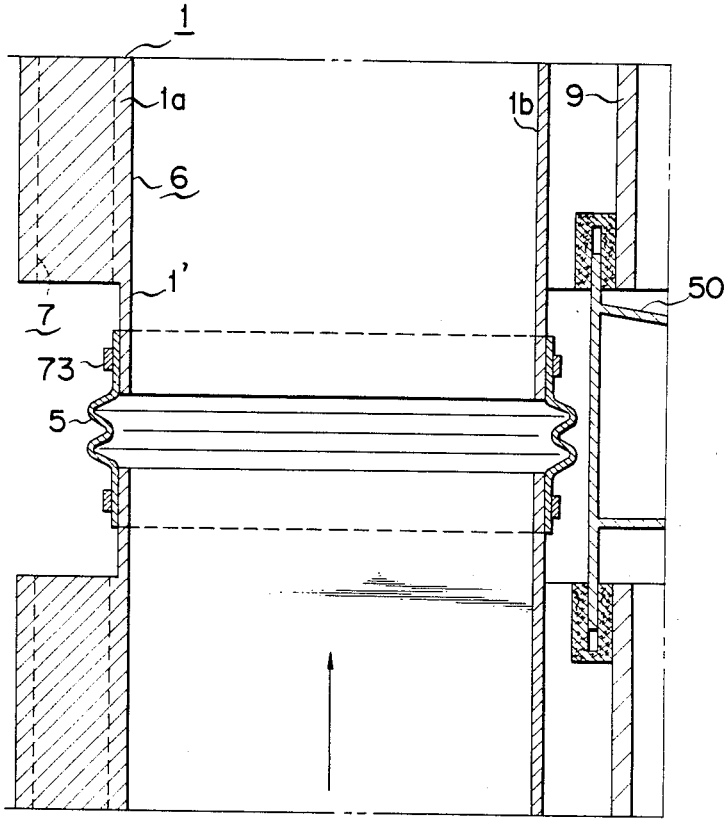
FIG. 3 is an enlarged, fragmentary vertical section through the unit type curtain wall assembly, taken along the line III—III of FIG. 2, the view showing in particular the means for fluid-tightly joining the ends of the side frame members of the vertically adjoining curtain wall units.

An inspection of FIG. 3 will reveal that the walls defining the second passageway 7 and recess 8, and the connector 9, of each side frame member 1 are cut short at their opposite ends, leaving only the thin walls 1' bounding the first passageway 6. The aforementioned bellowslike member 5 is fitted over the opposed thin walls 1' of the neighboring side frame members 1 which are in vertical alignment. A pair of clamp bands 73 secure the opposite ends of the bellowslike member 5 to the respective side frame members 1. Thus the first passageways 6 in the vertically alinged side frame members 1 intercommunicate for the uninterrupted flow of the conditioned air as indicated by the arrow in FIG. 3.

Figure 4:
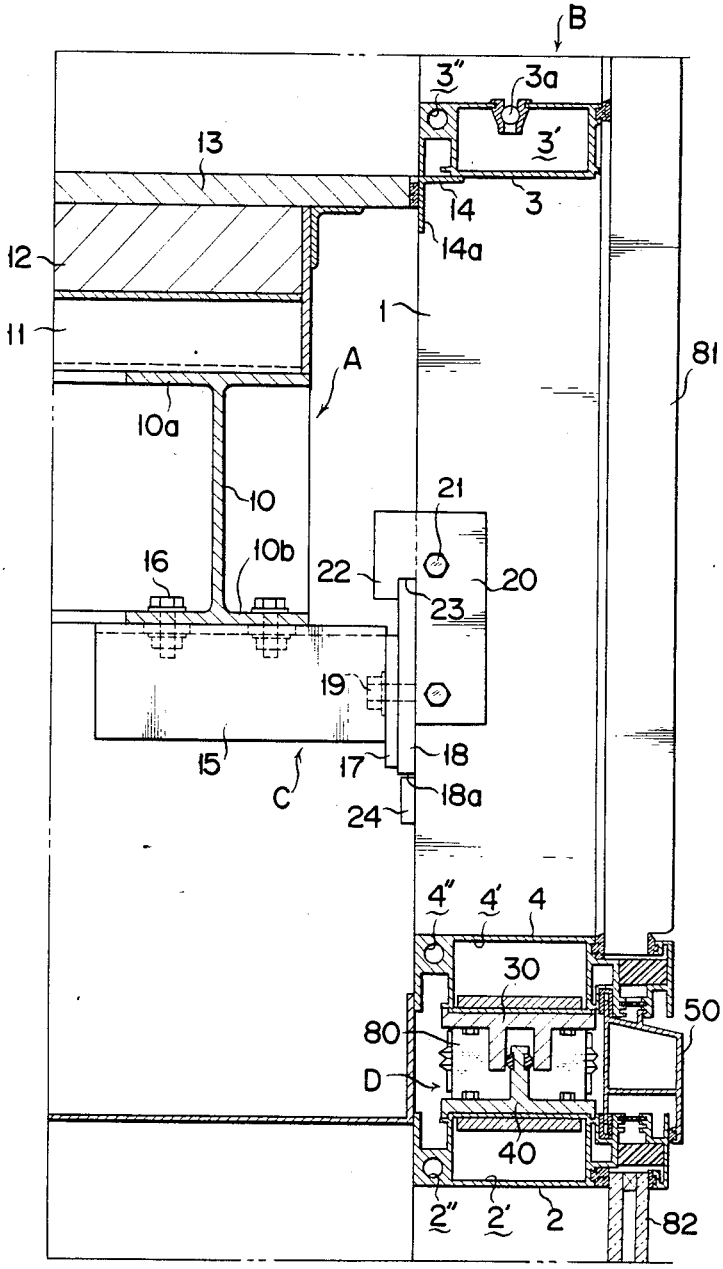
FIG. 4 is an enlarged, fragmentary vertical section through the unit type curtain wall assembly, taken along the line IV—IV of FIG. 1, the view showing in particular the means for mounting each curtain wall unit to a floor system of a building, as well as one of the couplings and one of the stringcourses between the vertically adjoining curtain wall units.

FIG. 4 indicates that the top frame member 2, plinth 3, and bottom frame member 4 of each curtain wall unit are analogous in cross sectional shape with the pair of side frame members 1. They have the first passageways 2', 3' and 4' and the second passageways 2'', 3'' and 4'', respectively. Further, as has also been mentioned, the plinth 3 has the series of vents 3*a* in communication with the first passageway 3' for the discharge of the conditioned air.

Also shown in detail in FIG. 4 is the floor system A to which each horizontal row of curtain wall units are mounted. The floor system A includes I-sectioned floor beams 10. Stacked on the top flanges 10*a* of the floor beams are decking 11, concrete subflooring 12, and flooring 13 of any suitable material.

The plinth 3 of each curtain wall unit lies just above the level of the flooring 13. An L-shaped bracket 14 is secured to the underside of the plinth 3 along its edge directed toward the room. The gap between the depending portion 14*a* of the bracket and the flooring 13 is filled with a backup material and finished by caulking.

With reference directed further to FIG. 4 each set of mounting means C, by which each curtain wall unit is attached to the floor system A as in FIG. 1, includes an L-shaped mounting plate 15 bolted at 16 to the bottom flange 10*b* of the floor beam 10. The mounting plate 15 has a welded-on end plate 17 to which an upstanding support plate 18 is screwed or otherwise fastened at 19. The support plate 18 has its top edge engaged in a recess 23 in a hook 22 formed integral with a bracket 20 which is fastened at 21 to one of the side frame members 1 of each curtain wall unit. Thus, by one pair of such mounting means C, each curtain wall unit is mounted to and suspended from one floor system A.

Seen at 24 in FIG. 4 is a limit stop which is affixed to each side frame member 1 just under the bottom edge 18*a* of the support plate 18 after the engagement of the hook 22 onto the top edge of the support plate. As the same implies, the limit stop 24 functions to limit the upward displacement of the side frame member 1 relative to the floor system A and hence to prevent the disengagement of the hook 22 from the support plate 18.

Figure 5:
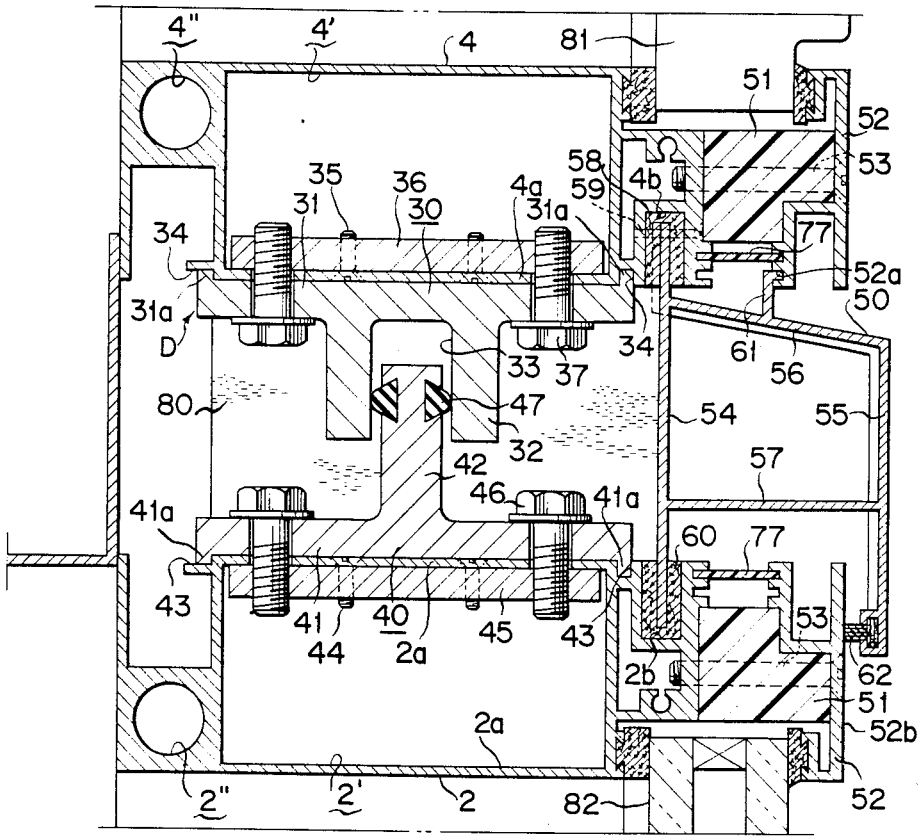
FIG. 5 is a still more enlarged, fragmentary vertical section showing the coupling and stringcourse of FIG. 4 in further detail.

While FIG. 4 shows one of the couplings D in some detail, FIG. 5 better illustrates the details of each coupling. The pair of couplings D between every two vertically adjoining curtain wall units are identical in construction and operation, so that the description of one coupling applies to the other.

The representative coupling D of FIG. 5 comprises a female member 30 affixed to the bottom frame member 4 of one curtain wall unit, and a male member 40 affixed to the top frame member 2 of the underlying curtain wall unit. The female member 30 comprises a mounting base 31 in direct contact with the bottom frame member 4 of the upper curtain wall unit, and a pair of ridges 32 depending therefrom in parallel spaced relation to each other to define therebetween a groove 33 extending in the vertical plane containing the curtain wall assembly. The mounting base 31 of the female member has a pair of side rims 31*a* directed upwardly from its opposite sides. These side rims are engaged in recesses 34 formed correspondingly in the bottom wall 4*a* of the bottom frame member 4. Further the mounting base 31 is secured to the bottom frame member 4 as by cap screws 37 which are threadedly engaged in a backing 36 fastened to the inside surface of the bottom wall 4*a* of the bottom frame member as by countersunk screws 35.

The male member 40 of the coupling D comprises a mounting base 41 attached directly to the top frame member 2 of the lower curtain wall unit, and an upstanding tongue 42 slidably engaged in the groove 33 in the female member 30. The mounting base 41 of the male member 40 also has a pair of side rims 41*a* directed downwardly from its opposite sides. The side rims 41*a* are engaged in recesses 43 formed correspondingly in the top wall 2*a* of the top frame member 2. Cap screws 46 pass through aligned holes in the mounting base 41 of the male member 40 and in the top wall 2*a* of the top frame member 2 and are threadedly engaged in tapped holes in a backing 45 which is fastened to the inside surface of the top wall 2*a* as by countersunk screws 44.

Thus, in the pair of horizontally spaced couplings D between every two vertically adjoining curtain wall units, the upstanding tongues 42 of the male members 40 are slidably engaged in the grooves 33 in the female members 30. Since the grooves 33 are contained in the vertical plane of the curtain wall assembly, the pair of couplings D allow the relative displacement of the two curtain wall units in every direction in their own plane but positively restrain them from relative displacement out of that plane.

Preferably, and as shown, a pair of contact strips 47 of nonmetallic, wear resistant material are embedded in the tongue 42 of each coupling D on its opposite sides in order to avoid the metal-to-metal contact of the male and female members 30 and 40. The contact strips 47 will serve to prevent the production of squeaks and the galling of the mating parts.

A further feature of the present invention resides in a stringcourse 50, shown also in FIG. 5, mounted between every two vertically adjoining curtain wall units so as to seal the joint therebetween. The stringcourse 50 is supported exteriorly of the couplings D by the following means.

A pair of retainer strips 52 are secured to the bottom frame member 4 of the upper curtain wall unit and to the top frame member 2 of the lower curtain wall units by countersunk screws 53 via heat insuratable connectors 51 and heat insulating plates 77. The stringcourse 50 comprises an inner vertical wall 54, an outer vertical wall 55, a sloping top 56 serving as a wash, and a horizontal bottom 57. Extending upwardly beyond the top 56, the inner wall 54 of the stringcourse 50 has its top edge engaged in a recess 4*b* in the bottom frame member 4 of the upper curtain wall unit via a resilient sealing strip 58 and is further held fast with respect to the bottom frame member by countersunk screws 59. The inner wall 54 of the stringcourse also extends downwardly beyond the bottom 57 to be engaged in a recess 2*b* in the top frame member 2 of the lower curtain wall unit via a resilient sealing strip 60. A mounting fin 61 extends upwardly from the middle of the sloping top 56 of the stringcourse. A rim of this mounting fin, bent outwardly from its top, is fitted in a groove 52*a* a defined in the retainer strip 52 on the bottom frame member 4 of the upper curtain wall unit. The outer wall 55 of the stringcourse extends downwardly beyond the bottom 57 and carries along its bottom edge a sealing strip 62 which butts on the outer surface 52*b* of the retainer strip 52 on the top frame member 2 of the lower curtain wall unit.

As is clear from the foregoing, the stringcourse 50 is rigidly fastened to the bottom frame member 4 of the upper curtain wall unit on the one hand and, on the other, is engaged with the top frame member 2 of the lower curtain wall unit for displacement in the plane of the curtain wall assembly. It will be appreciated that the stringcourse 50 effectively rainproofs the seam between every two vertically adjoining curtain wall units without the likelihood of being destroyed by the possible relative displacement of the curtain wall units.

The invention further features, although perhaps incidentally, a mass of thermal insulating material 80 packed in the space bounded by the bottom frame member 4 and top frame member 2 of every two vertically adjoining curtain wall units and by the stringcourse 50 therebetween. The thermal insulating material 80 functions to enhance the room temperature control capability of the curtain wall assembly.

Each curtain wall unit is additionally furnished with a face panel 81 of thermal insulating material and double glazing 82, both shown in FIGS. 4 and 5.

The present invention has been described hereinbefore as applied to the curtain wall assembly equipped for room temperature control. The curtain wall assembly makes use of the passageways in the frame members and plinths of the curtain wall units for the circulation of the heat transfer medium and conditioned air. This makes it possible to reduce the amount of piping in the floor systems to a minimum. As an additional advantage the installation of the temperature control system is essentially concurrent with the assemblage and mounting of the standardized curtain wall units.

Figure 6:
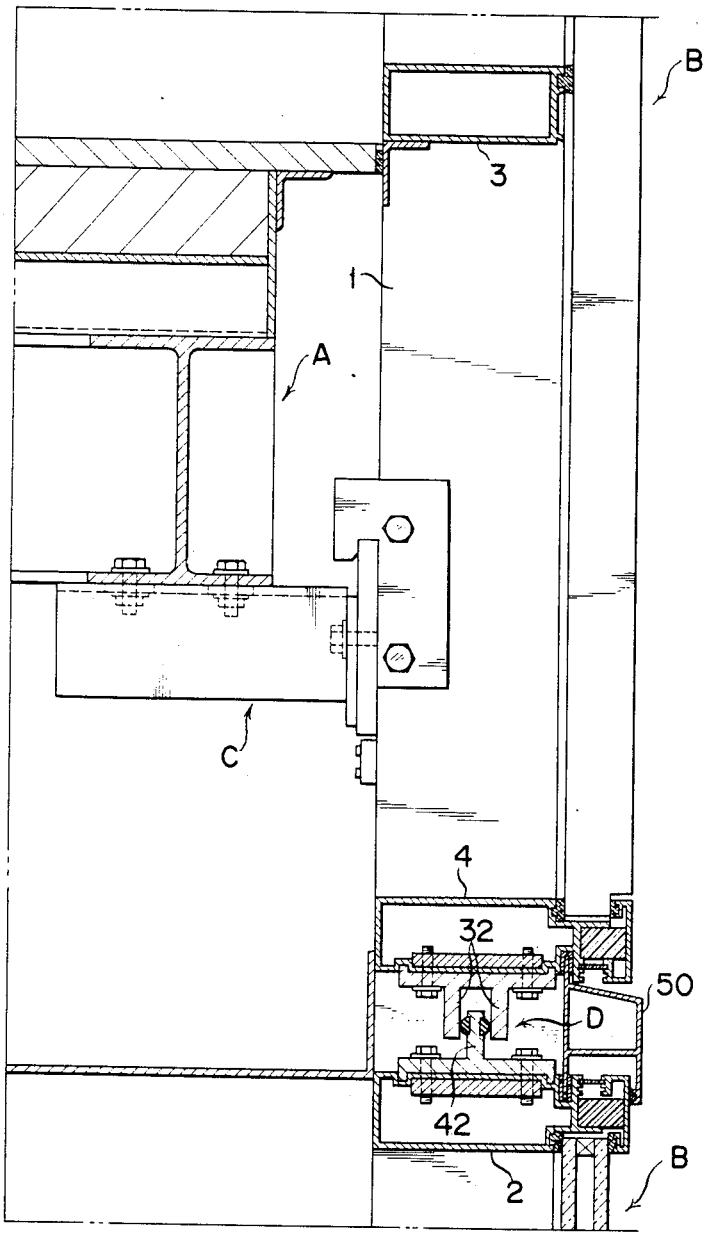
FIG. 6 is a view corresponding to FIG. 4 but showing the invention as applied to a unit type curtain wall assembly having no room temperature control system.

The principles of the invention do, however, find application to curtain wall assemblies having no temperature control function. FIG. 6 illustrates an example of such curtain wall assembly constructed in accordance with the invention. A comparison of this figure with FIG. 4 will reveal that this alternative embodiment is equivalent to the FIGS. 1 through 5 embodiment except for the absence of the fluid passageways in the frame members 1, 2 and 4 and plinths 3 of the curtain wall units B.

Thus the FIG. 6 embodiment also has the pair of couplings D between the bottom frame member 4 and top frame member 2 of every two vertically adjoining curtain wall units, and the stringcourse 50 sealing the seam therebetween against the intrusion of water. The constructional details of the couplings D and stringcourse 50, and the manners of their mounting to the pertinent parts of the curtain wall units, can be exactly as set forth above in connection with the preceding embodiment. It will also be seen that each curtain wall unit has its side frame members 1 engaged with one floor system A via the mounting means C constructed as in the preceding embodiment.

Figure 7:
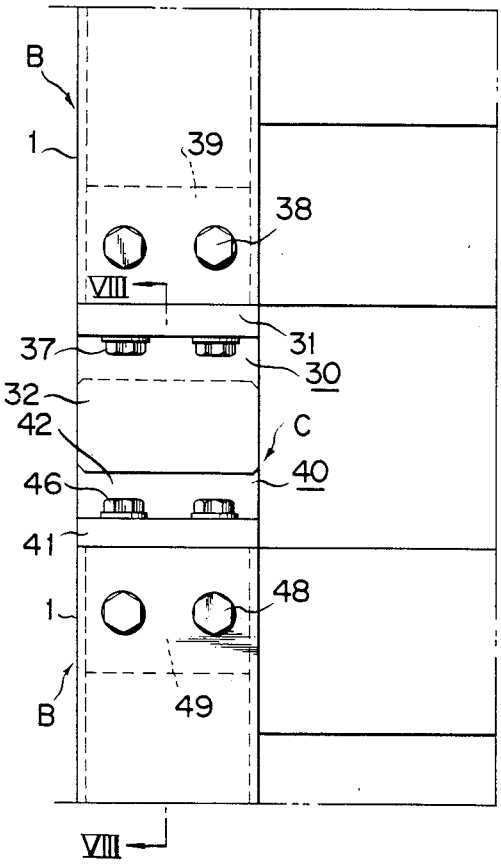
FIG. 7 is a fragmentary elevation of a further preferred embodiment of the invention in which the inventive concepts are also applied to a unit type certain wall assembly having no room temperature control system.
Figure 8:
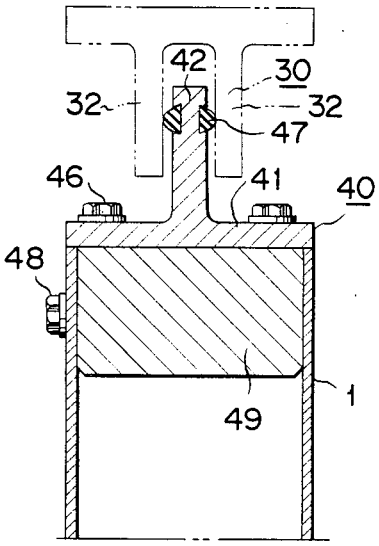
FIG. 8 is a fragmentary vertical section through the unit type curtain wall assembly of FIG. 7, taken along the line VIII—VIII therein.

In the application of the inventive principles to curtain wall assemblies having no temperature control function, the pair of couplings D need not be mounted between the top and bottom frame members of the adjacent curtain wall units as in the FIG. 6 embodiment. FIGS. 7 and 8 show an additional embodiment wherein the pair of couplings D are mounted between the opposed ends of the pairs of side frame members of every two vertically adjoining curtain wall units.

As in the foregoing embodiments each coupling D comprises a female member 30 having the pair of ridges 32 depending from the mounting base 31, and a male member 40 having the tongue 42 erected on the mounting base 41. The mounting base 31 of the female member 30 is screwed at 37 to a fill block 39 which is closely engaged in the bottom end of one of the side frame members 1 of the upper curtain wall unit B and retained in position by screws 38. The mounting base 41 of the male member 40 is screwed at 46 to a fill block 49 which is closely engaged in the top end of one of the side frame members 1 of the lower curtain wall unit B and retained in position by screws 48. The tongue 42 of the male member 40 is slidably engaged in the groove in the female member 30 via the pair of contact strips 47. The other details of construction are considered self-evident from the description of the previous embodiments.

It is understood that the invention is not to be limited by the exact details of the embodiments disclosed herein. For instance, although each coupling D has its female member 30 coupled to an upper curtain wall unit, and its male member 40 to a lower curtain wall unit, in the illustrated embodiments, it is also possible that the female member be coupled to a lower curtain wall unit, and the male member to an upper curtain wall unit. Additional modifications or alterations of the invention will readily occur to one skilled in the art without departing from the scope of the invention.

What is claimed is:

1. In a unit type curtain wall assembly having a plurality of standardized curtain wall units arrayed in rows and columns, the improvement comprising a plurality of horizontally spaced apart couplings between every two vertically adjoining curtain wall units, each coupling having a female member attached to either of the upper and lower curtain wall units and a male member attached to the other of the upper and lower curtain wall units, the female and male members being freely disposed separate of one another, the female member defining a groove extending in a vertical plane containing the curtain wall assembly, the male member having a tongue slidably engaged in the groove in the female member, whereby the vertically adjoining curtain wall units are relatively displaceable in their own plane while being restrained from relative displacement out of the plane, and a stringcourse sealingly mounted between every two vertically adjoining curtain wall units and disposed exteriorly of the couplings for rainproofing the same between the curtain wall units.

2. The unit type curtain wall assembly of claim 1 wherein each curtain wall unit comprises top, bottom and pair of side frame members joined into a rectangular shape, and wherein the couplings are mounted between the top and bottom frame members of the adjoining curtain wall units.

3. The unit type curtain wall assembly of claim 1 wherein each curtain wall unit comprises top, bottom and pair of side frame members joined into a rectangular shape, and wherein the couplings are mounted between the opposed ends of the side frame members of the curtain wall units.

4. The unit type curtain wall assembly of claim 1 further comprises a mass of thermal insulating material filled in a space bounded by every two vertically adjoining curtain wall units and by the stringcourse therebetween.

5. The unit type curtin wall assembly of claim 1 wherein the male and female members of each coupling are both made of metal, and wherein the male and female members of each coupling make sliding engagement with each other through nonmetallic contact means.

6. The unit type curtain wall assembly of claim 5 wherein the nonmetallic contact means comprises a pair of contact members embedded in the tongue of the male member on both sides thereof.

7. The unit type curtain wall assembly of claim 1 wherein each curtain wall unit comprises top, bottom, and pair of side frame members joined into a rectangular shape, and a plinth extending between the side frame members and located intermediate the top and bottom frame members, each of the frame members and the plinth defining at least one fluid passageway extending longitudinally therethrough, wherein the side frame members of each column of curtain wall units are joined end to end via hollow flexible members so as to intercommunicate the fluid passageways therein, and wherein the couplings are mounted between the opposed top and bottom frame members of the adjoining curtain wall units.

8. The unit type curtain wall assembly of claim 7 wherein each hollow flexible member is a bellows fitted over and clamped on to the opposed ends of the side frame members.

* * * * *